US006688793B2

(12) United States Patent
Goyet

(10) Patent No.: US 6,688,793 B2
(45) Date of Patent: Feb. 10, 2004

(54) APPLICATOR DEVICE FOR APPLYING PRODUCT

(75) Inventor: Daniel Goyet, Witz (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/989,194

(22) Filed: Nov. 21, 2001

(65) Prior Publication Data

US 2002/0061221 A1 May 23, 2002

(30) Foreign Application Priority Data

Nov. 22, 2000 (FR) ..... 00 15074

(51) Int. Cl.[7] ..... B43K 5/06
(52) U.S. Cl. ..... 401/175; 401/172
(58) Field of Search ..... 401/175, 174, 401/172, 171, 65, 68, 55; 222/390, 391

(56) References Cited

U.S. PATENT DOCUMENTS

| | | | | |
|---|---|---|---|---|
| 2,917,765 A | | 12/1959 | Jakubowski | |
| 4,298,036 A | | 11/1981 | Horvath | |
| 5,000,356 A | | 3/1991 | Johnson et al. | |
| 5,007,755 A | | 4/1991 | Thompson | |
| 5,025,960 A | * | 6/1991 | Seager | 222/390 |
| 5,947,621 A | | 9/1999 | Szekely | |
| 6,086,276 A | * | 7/2000 | Gueret | 401/54 |

FOREIGN PATENT DOCUMENTS

| | | | | |
|---|---|---|---|---|
| DE | 20 27 483 | | 12/1971 | |
| DE | 2807472 A | * | 8/1979 | 401/175 |
| FR | 1 582 030 | | 9/1969 | |
| FR | 2 556 696 | | 6/1985 | |
| GB | 890 683 | | 3/1962 | |

* cited by examiner

*Primary Examiner*—Gene Mancene
*Assistant Examiner*—Huyen Le
(74) *Attorney, Agent, or Firm*—Finnegan Henderson Farabow Garrett & Dunner, L.L.P.

(57) ABSTRACT

The present invention relates to an applicator for a product comprising a body having an interior and a first end closed by an applicator wall. A piston is configured to move in a sealed manner along the interior of the body and to be driven by a drive mechanism configured to drive the piston towards the applicator wall to cause product to pass through the applicator wall. The applicator may further include a rod associated with the drive mechanism, the rod comprising a channel passing through at least a portion of the rod. The channel may have a first opening configured to open to the outside of the body and at least one second opening located between the piston and the applicator wall when the piston is located at a maximum distance from the applicator wall. The rod may also define at least one vent orifice.

69 Claims, 5 Drawing Sheets

APPLICATOR DEVICE FOR APPLYING PRODUCT

The present invention relates to an applicator for a product, such as a semi-fluid product, for example, wherein the applicator includes an applicator wall.

In general, a semi-fluid product as defined herein is to be understood as being a viscous product having a consistency such that it may flow under the effect of its own weight. By way of example, such a product may be in the form of a cream, a paste or a gel.

Optionally, the applicator is intended to apply topically a product with a cosmetic or dermopharmaceutical action, such as a deodorant, scented product, thinning product, depilatory cream, a face cream, and/or a gel for treating the scalp, for example.

The applicator, according to an optional aspect, may be of the type comprising a body having an end closed by a product-permeable applicator wall. The applicator may comprise a piston capable of sliding in a sealed manner against an interior wall of the body and of passing from a first position in which the piston may be at substantially a maximum distance from the applicator wall to a second position in which the piston may be at substantially a minimum distance from the applicator wall. The applicator may comprise a rod associated with a drive mechanism, for example, a mechanism with a screw thread in combination with a rotary knob, for driving the piston towards the second position and forcing the product through the applicator wall.

In another optional aspect, the present invention may relate to an applicator of the aforementioned type, which is filled from the bottom, that is to say from the opposite end of the body to the applicator portion of the applicator.

DESCRIPTION OF THE RELATED ART

DE 2 027 483 describes an applicator having a container with an internal cross section in a circular shape. The applicator portion consists of an attached element having an orifice at its center. The applicator portion is in the form of a sponge having a hole at its center, or a wall made of polyethylene and having an exterior surface with spiral grooves for distributing product that comes out of a single central orifice. The disadvantages of a structure such as this are many. The circular shape of the body of the container, and therefore of the piston, mean that in order to prevent the latter from turning, it has to be mounted very tightly inside the body, particularly via an elastic steel filament, which forces the piston to press constantly against the internal walls of the container. Operation of such a circular applicator device may require a relatively large force to cause the piston to travel towards the applicator portion.

Added to this potential disadvantage is the additional assembly step dictated by the fact that the applicator portion is attached. Furthermore, the presence of a single central orifice means that the central orifice has to be produced with a relatively large cross section. As a result, unless the cap comprises an element that, in the closed position, becomes inserted inside the central orifice so as to seal it off, the risk of inadvertent dispensing of product when the device is in the storage position is relatively high. Furthermore, despite the presence of grooves on the applicator surface, product is not spread out over the applicator surface as uniformly as it might be. Additionally, the grooves are sources of soiling of the applicator surface.

U.S. Pat. No. 4,298,036 describes an applicator having a product that can be filled from the bottom via a hollow part of a shaft that drives a plunger. Air escapes through a hole provided in the plunger. An end of the housing in the filling position is delimited by an inner piece with a desired profile, and held in position, for example by means of a removable cap. After a certain period, the product sets to form a solid stick. Upon first use, the user removes the inner piece and applies the product, using the upper surface of the stick itself as the applicator surface.

Apart from the absence of an applicator wall capable of "closing" the body at an application end, throughout the life of the applicator, the position of the vent orifice in the plunger makes the use of such an applicator inappropriate for a stick other than a solid one. This is because, in the case of a semi-liquid product, for example a creamy product, a certain amount of product would inevitably escape through the vent orifice under the pressure generated by the movement of the plunger. This leakage would contaminate at least the portion of the applicator situated beneath the plunger.

Elsewhere, there are devices in which the piston and the mechanism that drives the piston are mounted after filling from the bottom and thus do not provide a channel for filling the applicator while the piston is in place on the applicator. The problem with such a configuration lies in the difficulty to achieve this assembly after filling. That is to say with product present. In an assembly environment using industrial tooling, for example, there may exist substantial risks of some of the product escaping from the housing and soiling the mechanism.

Filling the housing of the applicator from the top may preclude producing the applicator portion in the form of an apertured wall obtained by molding with the body of the applicator. Furthermore, mounting an applicator portion, for example in the form of a grating or of a porous element, after the housing has been filled, may prove difficult in an industrial production environment.

SUMMARY

Hence, one of the optional aspects of the invention may be to provide an applicator that may solve one or more of the problems discussed hereinabove with reference to certain conventional devices.

One aspect of the invention may be to produce such an applicator that may be simple and economical to produce. Another aspect of the invention may be to provide an applicator that may be relatively simple and economical to fill, for example, on an industrial production line. Yet another aspect of the invention may be to produce an applicator with a configuration that may be filled on an industrial production line, for example, while reducing the risks of product soiling the outside of the housing.

Other further aspects will become apparent from the detailed description that follows.

According to the invention, there is an applicator, for example for a cosmetic product, comprising a body having an interior and one end closed by an applicator wall. The applicator may further comprise a piston capable of sliding in a sealed manner along an interior of the body, and a rod associated with a drive mechanism for driving the piston towards the applicator wall to cause or force product to pass through the applicator wall.

The rod may have passing through it, over at least part of its length, a channel configured to open onto the outside of the body via a first opening and also opening into the body via at least one second opening. The at least one second opening may be arranged between the piston and the applicator wall when the piston is substantially a maximum distance away from the applicator wall. The rod may also have passing through it at least one vent orifice configured to allow air to escape, for example, while the body is being filled with product via the channel.

The body may be of non-circular interior cross section, and/or the applicator wall may be made of a single-piece unit with the body, for example by molding. The applicator wall may optionally have, passing through it, a number of orifices. The configuration of these orifices may allow product to be spread in such a way as to distribute the product over substantially the entire surface of the applicator wall.

A non-circular (for example rectangular, ovoid or elliptical) shape of the internal cross section of the body may allow the piston to be prevented from rotating within the body without special immobilizing means or without demanding a substantially high bearing force between the peripheral lip of the piston and the internal surface of the body. Operation may, therefore, be easier.

The applicator according to one aspect of the invention may be relatively simple to assemble because the body and the applicator wall may be produced as a single piece. This also may make it possible to get around the problems of sealing that could result from an arrangement in which the applicator wall were attached to the body as a separate piece.

Unlike a configuration with one single central orifice, a small cross section of many orifices in the configuration according to one aspect the invention may allow the use of the device for products, for example, of lower viscosity and may reduce the risk of inadvertent dispensing of product that may result from pressure accidentally exerted on one or more of the walls of the container when the container is in a storage position. As a result, it may not be necessary to provide elements to close off these orifices when the applicator is in a closed position. Furthermore, spreading of product over the surface of the applicator wall may be better than in conventional devices.

According to another aspect, the volume formed between the piston and the applicator wall could be filled with product through the channel in the rod. If done in this manner, a stopper may be fitted to close off the first opening. The stopper could, for example, be fitted on an industrial production line. This could allow the fitting of the stopper to be carried out automatically with a minimized risk of the applicator or its environment being soiled with product.

Because of a pressure gradient that may exist between the region of the applicator wall and the inside of the rod, at the location where the vent orifices may be formed, a risk of product escaping from the area defined between the piston and the applicator wall, such as towards the actuating mechanism, when the piston is driven towards the applicator wall, may be appreciably reduced. These risks may also be reduced by the fact that the cross section of the vent orifice may be negligible by comparison with the total cross section of the orifices in the applicator wall.

The at least one vent orifice may be arranged in such a way that during filling, it may lie above a maximum level of product. This may allow the vent to be effective throughout the filling period. As an option, the at least one vent orifice may arranged near the piston when the piston is substantially a maximum distance away from the applicator wall, but still engaged with the rod.

A maximum diameter of the vent orifice(s) may be chosen, for example, according to a viscosity of the product intended to be contained in the applicator. The maximum diameter may be chosen so that if there is no appreciable raised pressure inside the container, the product may not flow out through the orifices of the applicator wall under the effect of its own weight. Thus, the more viscous the product, the larger the cross section of the vent orifice may be. Typically, the vent orifice(s) may have a diameter of from about 0.3 mm to about 1 mm.

In addition, the applicator wall may have practically no orifice facing a free or second end of the rod so as to cause the portion of the applicator wall without orifices to be impermeable to product. This impermeable portion facing the rod could optionally have approximately the same cross-section as the rod. The presence of orifices directly in the axis of the rod, particularly when the product is introduced at a relatively high rate, could allow, during filling, product to pass between the applicator wall and the cap or between the applicator wall and a removable inner seal that may be present during filling. This may result in soiling of either of the internal surface of the stopper or of the applicator surface. Alternatively, the channel passing through the rod may not open axially.

The orifices passing through the applicator wall may be from 20 to 50 in number. The diameter of the holes may be on the order of about 1 to about 1.5 mm.

According to an exemplary embodiment, the rod may have a screw threading capable of engaging with a corresponding screw threading provided on the piston. These screw threadings could allow driving the piston towards the applicator wall in response to an actuating command exerted, for example, on a rotary knob. Alternatively, the drive mechanism may include a ratchet mechanism associated with a button that may be pushed in to cause the piston to advance within the body.

The at least one other opening may be arranged near a free end of the rod situated near the applicator wall. As an option, the at least one second opening may open laterally or radially from the rod. The rod may define one or more of these lateral openings for communication with the body. As an option, the rod may comprise at least two lateral or radial openings that may open away from one another on the rod.

To allow for an easier release of the rod if made by a molding process, the lateral openings may open onto an edge formed by the free end of the rod.

The free end of the rod may be in contact with an interior surface of the applicator wall. Thus, if the rod is hollow along substantially its entire length, and ends in an axial opening, the axial opening may be closed off in a substantially impervious manner by the interior surface of the applicator wall. The free end may, however, be at a non-zero distance from the interior surface of the applicator wall, which could allow for an increase of the filling rate.

The end of the body at the opposite end of the applicator wall may have an attached bottom. The attached bottom may have an opening communicating with the first opening of the channel. This bottom may allow the applicator to be produced in the form of a more or less closed volume.

The first opening of the channel may, after filling, be closed off by a stopper. The stopper could be fixed, for example, by snap-fastening, bonding, screwing, and/or welding. Within the meaning of the present invention, the term "stopper" includes any element capable of sealing the first opening. It may also be a bonded or heat-sealed inner seal.

Depending on the rheology of the product, and on the general configuration of the applicator, it may be desirable, after filling, to close off the vent orifice in such a way as to ensure that substantially no product may flow through the vent orifice, for example, under thrust of the piston.

Additionally, a portion of the stopper closing off the first opening may be configured in such a way that, if mounted on the applicator, it may isolate the inside of the rod from the outside of the rod. A skirt that may be used to attach the stopper to the applicator may be extended so that it extends at least as far as the at least one vent orifice, so as to close it or them off.

Optionally, the applicator according to an aspect of the invention may comprise a cap mounted removably, for example by clipping, on the body so as to isolate the applicator wall in a substantially impervious manner from the outside.

As an option, a removable inner seal that is substantially impervious to product may be fixed, prior to first use, to the applicator wall, for example by bonding or heat sealing. An inner seal, aside from being able to protect the cap during filling, may constitute evidence of tampering. Alternatively, it may improve the impervious nature of the applicator, for example, while it is being transported or stored prior to its first use.

The applicator according to an aspect of the invention may be used for applying, for example, a cosmetic product, such as in the form of a cream, a gel, or a paste.

BRIEF DESCRIPTION OF THE DRAWINGS

The accompanying drawings are included to provide a further understanding of the invention and are incorporated in and constitute a part of this specification. The drawings illustrate exemplary embodiments of the invention and, together with the description, serve to explain certain principles. In the drawings.

DESCRIPTION OF EXEMPLARY EMBODIMENTS

Figure 1:
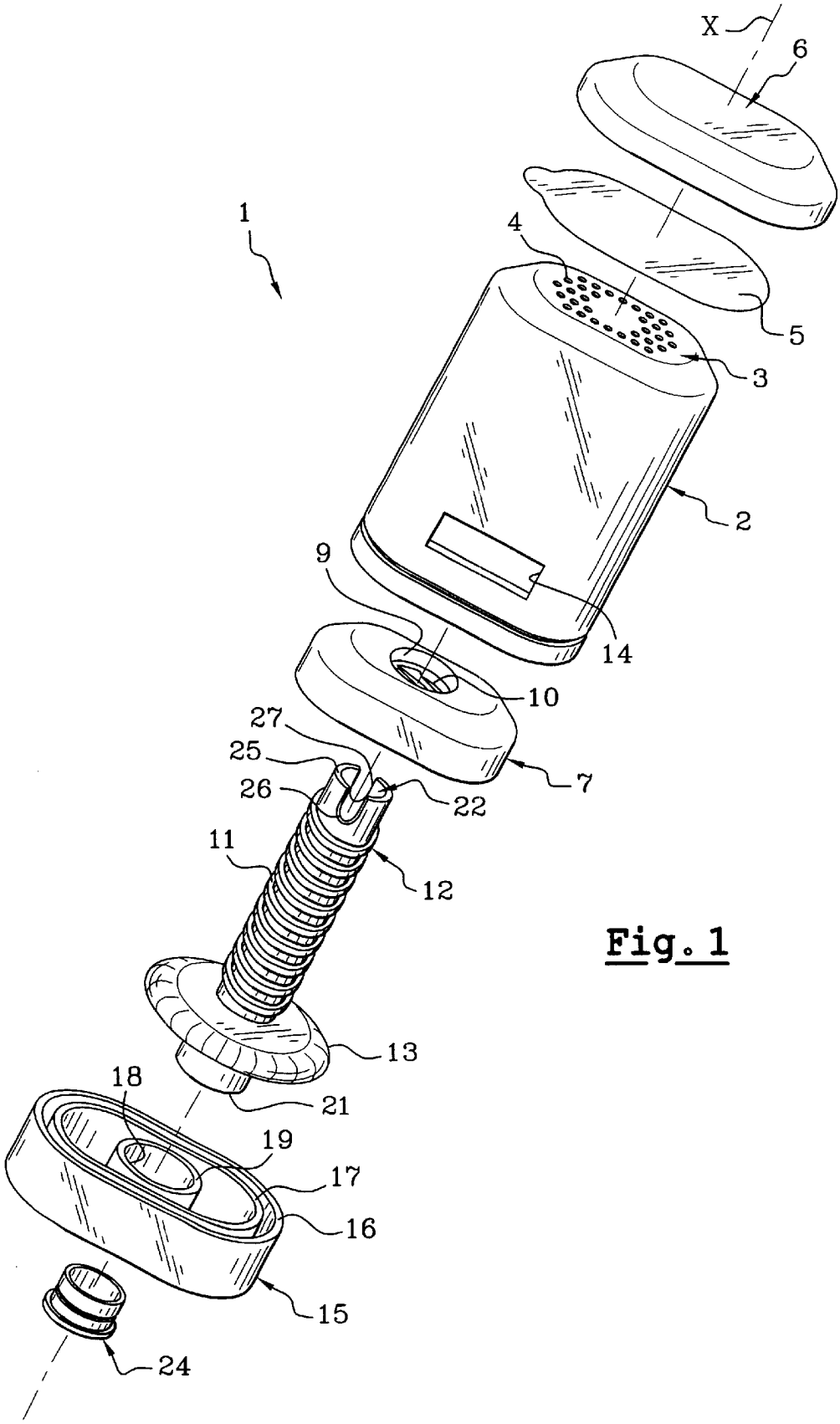
FIG. 1 is an exploded view of the applicator according to an exemplary embodiment.

Reference will now be made in detail to exemplary embodiments of the invention, examples of which are illustrated in the accompanying drawings. Wherever possible, the same reference numbers are used in the drawings and the description to refer to the same or like parts, and the same reference numbers with alphabetical suffixes or numerical prefixes are used to refer to similar parts.

Figure 2A:
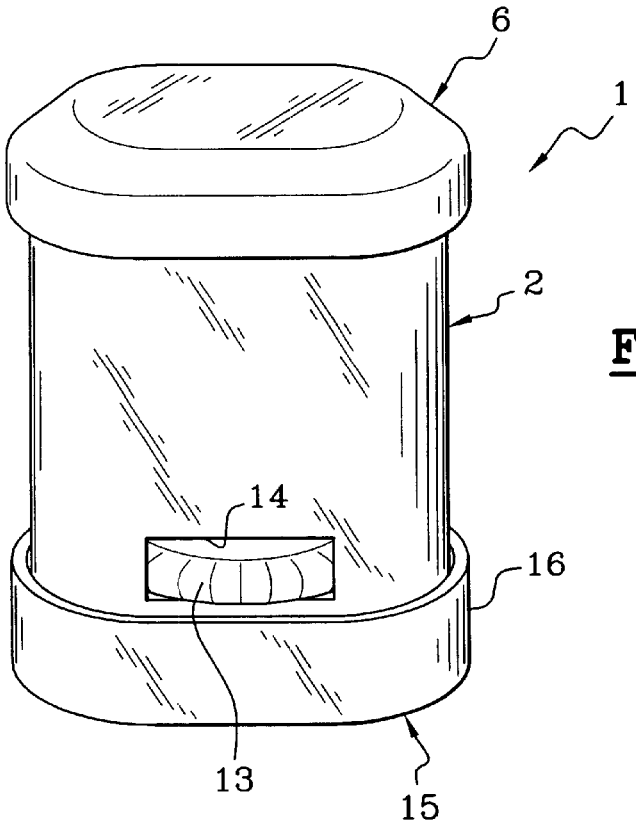
FIG. 2A is a perspective view of the assembled applicator of FIG. 1.
Figure 2B:
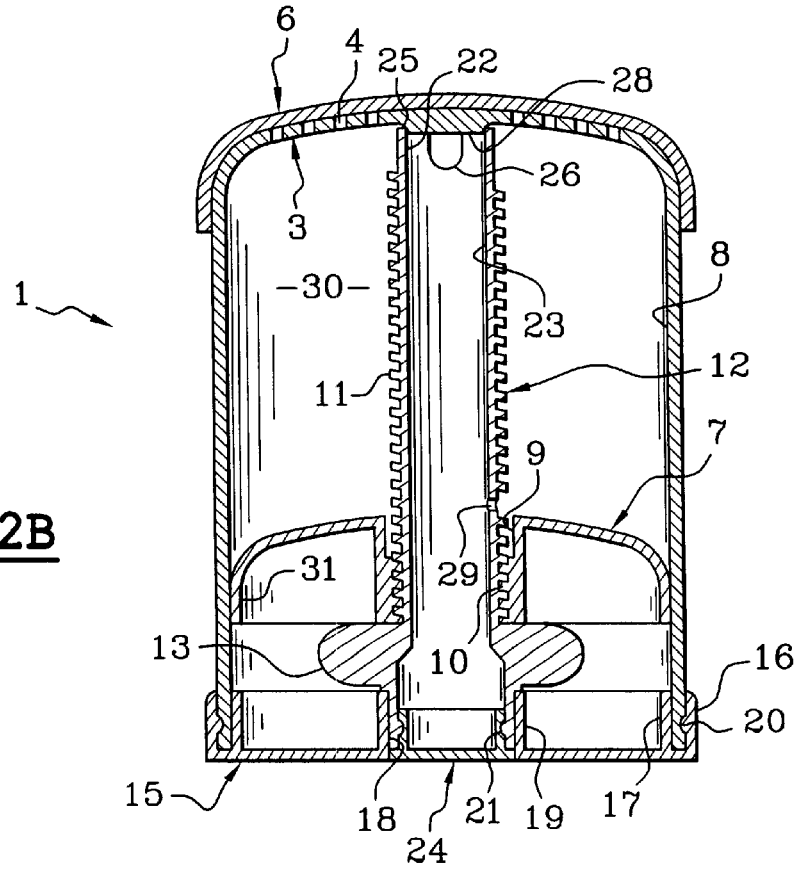
FIG. 2B is a cross-section view of the applicator of FIG. 2A.

The applicator 1 depicted in FIGS. 1 and 2A–2B comprises a hollow body 2 of elongate cross section, one end of which ends in a wall 3 through which there pass a number of orifices 4 of relatively small cross section that are distributed across substantially the entire surface of the wall 3, except for a center portion. The mean diameter of the orifices 4 may be of the order of about 1 mm.

The body 2 including the end wall 3 may be obtained by molding in a single piece using, for example, a material such as polypropylene.

An inner seal 5 may be affixed or bonded to the wall 3 by, for example, heat-sealing. The inner seal 5 may be made of, for example, aluminum or a plastic/aluminum complex, and may be configured to be removed prior to first use. A removable cap 6 may make it possible, for example between uses, to substantially seal the holed wall 3 from the outside. The cap 6 may be mounted on the body 2 as a substantially tight fit or by reversible clipping on, among other mounting configurations.

Movably mounted inside the body 2 is a piston 7 having a lateral wall 31 capable of pressing in a sealed manner against the interior surface 8 of the body 2. Passing through the center of the piston 7 is an orifice 9 having an interior surface with a screw threading 10 capable of engaging with a corresponding screw threading 11 provided on the exterior surface of a threaded rod 12. The threaded rod 12 has a height along the axis X approximately equal to the axial height of the body 2.

About 1 cm from its lower end, the threaded rod 12 may be secured to a knob 13 capable, when the rod 12 and the piston 7 are mounted, of emerging partially through two windows 14 formed on the two long faces of the body 2, near its lower end.

Opposite the end wall 3, the body 2 may be closed by an attached bottom 15 comprising two lateral skirts 16, 17 defining a peripheral groove capable of accommodating the free edge of the body 2. The attached bottom 15 also comprises a central opening 18 delimited by an axial hollow shaft 19. The axial hollow shaft 19 may have an inside diameter slightly greater than an outside diameter of the threaded rod 12 so that the rod 12, being free to turn, may be inserted inside the axial hollow shaft 19.

A bulge/groove system 20 may allow the attached bottom 15 to clip onto the body 2.

The threaded rod 12 is depicted as hollow over its entire length, although the channel may extend through only a portion of rod 12. The rod 12, thus defines a channel 23 extending from an axial opening 21 situated near the knob 13 to an axial opening 22 situated at the opposite end of the rod. The inside diameter of the channel 23 may be on the order of about 8 to about 10 mm.

In the mounted position depicted in FIG. 2B, the axial opening 21 opens to the outside of the applicator. The opening 21, after the applicator has been filled with product, may be closed by a clipped-in stopper 24, although other stoppers known in the art may be used.

When the applicator is in the assembled position, the edge 25 defining the axial opening 22 may be in a sealed engagement with the outer edge of an additional thickness 28 formed by the interior surface of the end wall 3 so as to substantially seal the opening 22.

Opening into the edge 25 are two diametrically opposed lateral or radial openings 26, 27. The lateral openings may make it possible, when the applicator is assembled, for there to be communication between the channel 23 and the housing 30 formed between the piston 7 and the end wall 3.

Also passing through the threaded rod 12 is a vent orifice 29 which, when the piston 7 is in substantially its lowest position (FIG. 2B), is slightly above this piston. The diameter of the vent orifice 29 may be of the order of about 0.5 mm to about 1 mm.

Figure 4:
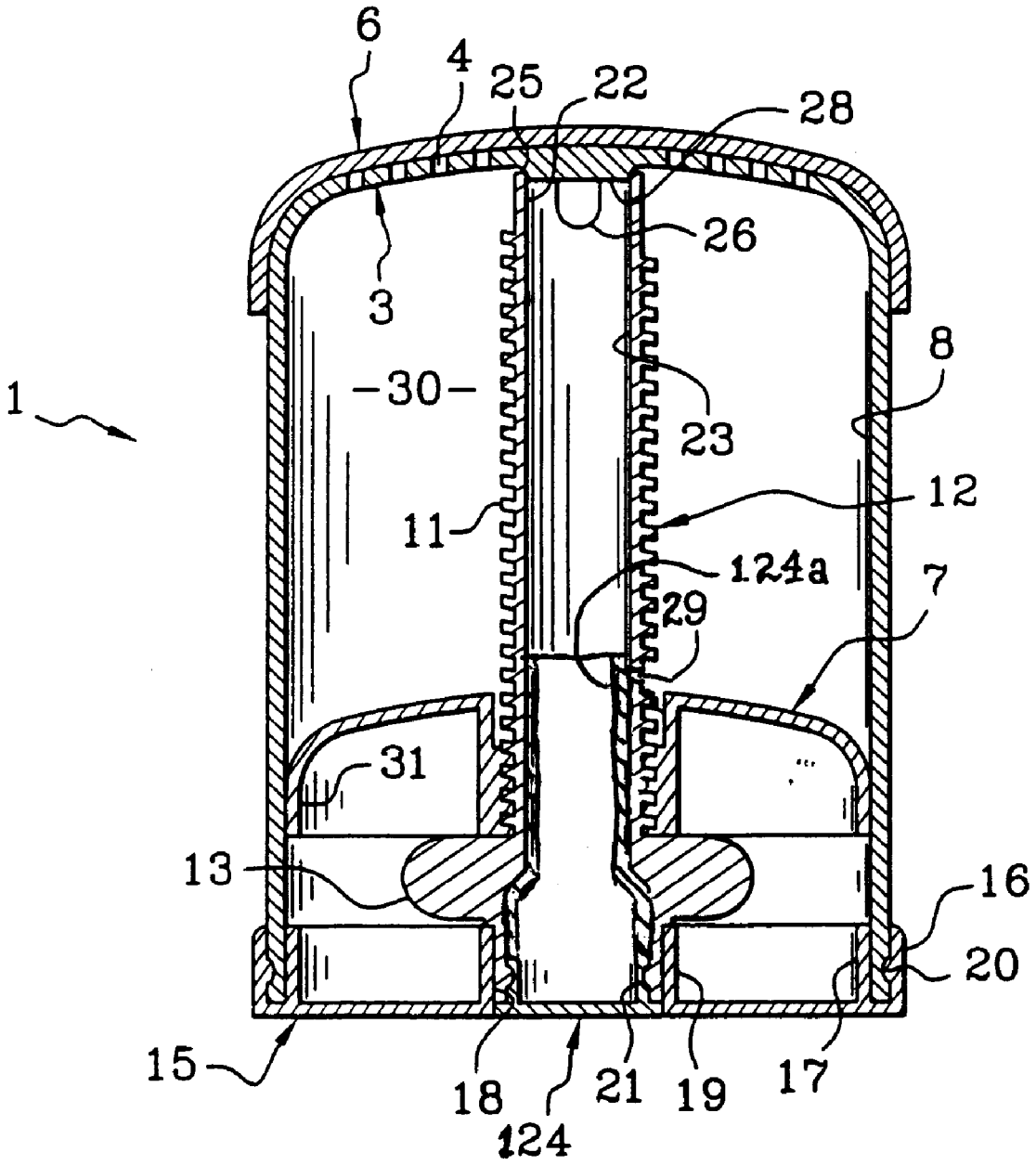
FIG. 4 is a cross-section view according to another exemplary embodiment showing a stopper capable of closing a vent orifice.

As depicted in the alternative embodiment of FIG. 4, the skirt of the stopper 124 may be long so that an elongated portion 124*a* of the skirt overlaps the vent orifice 29 in such a way as to close it off.

To use the applicator, the consumer may remove the cap 6 and, at the time of first use, if applicable, remove the inner seal 5. The user may then turn the knob 13 to drive the piston 7 towards the end wall 3. As a result, the product contained in the housing 30 may be pressurized and may emerge from the applicator via the orifices 4 of the end wall 3. The product may then be applied, for example, to a surface that is to be treated, by moving the applicator wall 3 over the surface.

Figure 3A:
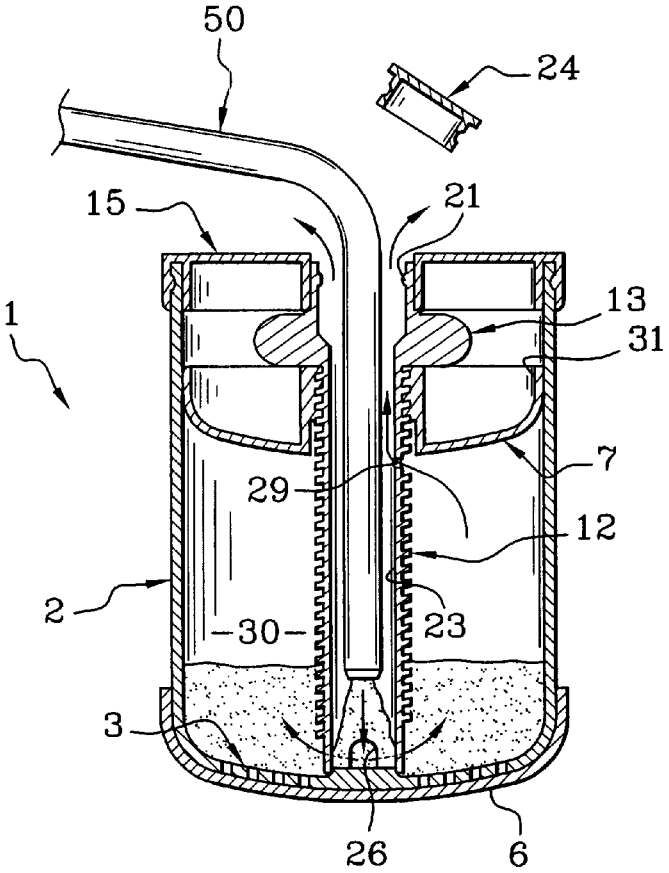
FIG. 3A is a cross-section view of the applicator of FIG. 2A showing a filling of the applicator with product.
Figure 3B:
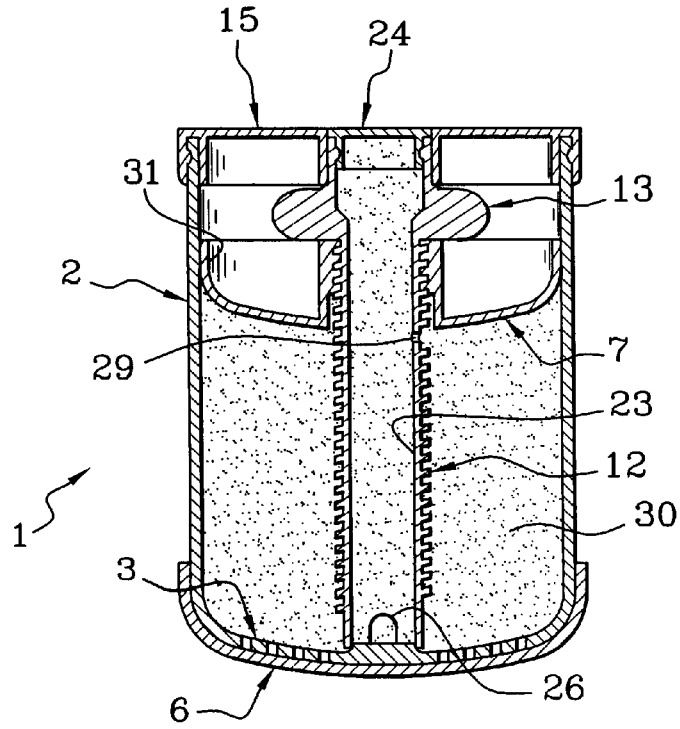
FIG. 3B is a cross-section view of the applicator of FIG. 2A filled with product.
Figure 5:
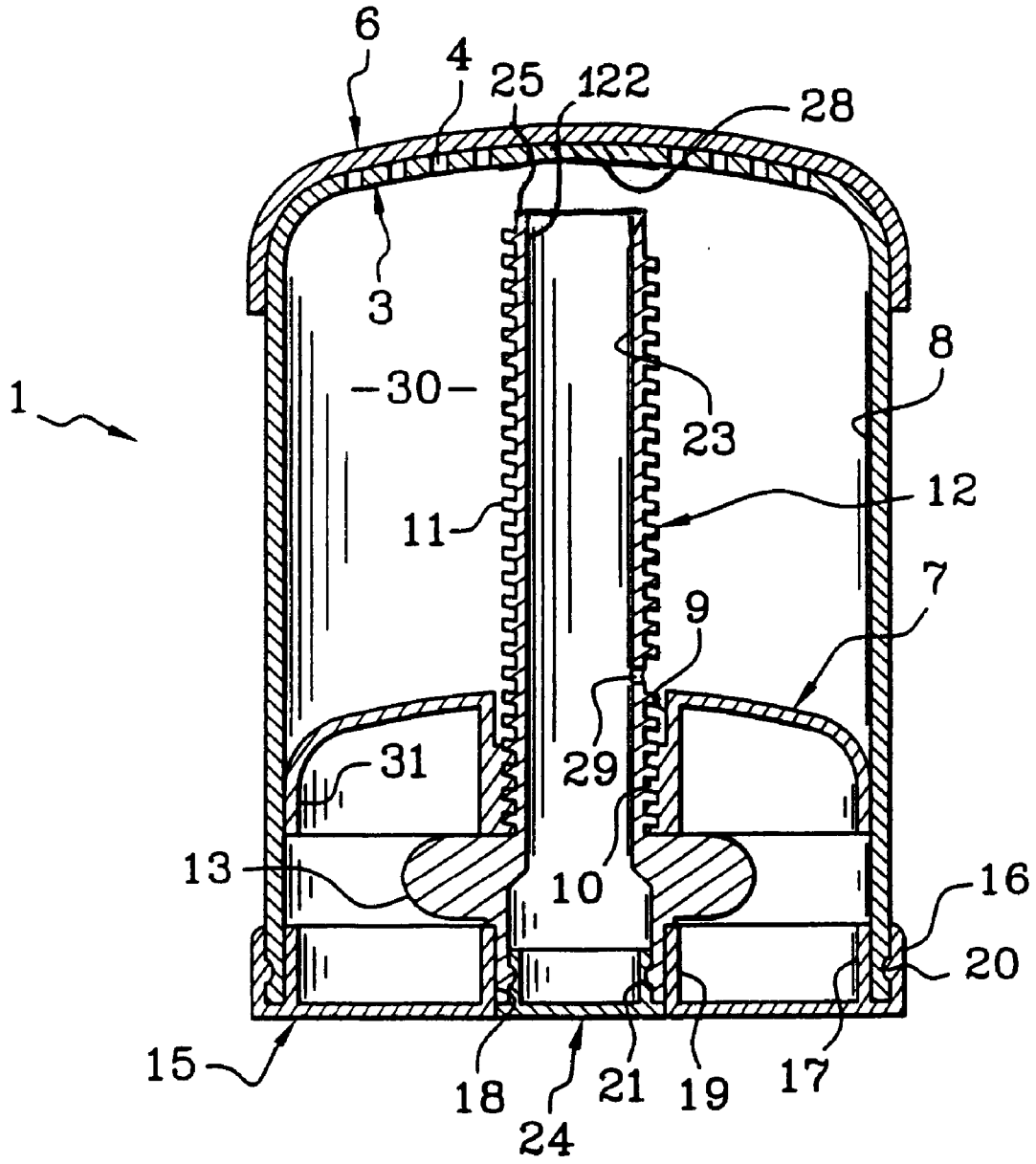
FIG. 5 is a cross-section view according to a further exemplary embodiment showing a rod that is spaced at a non-zero distance from the applicator wall.

FIGS. 3A–3B illustrate one possible process for filling the applicator. In FIG. 3A, the applicator is turned upside down, and the stopper 24 removed. The piston 7 is in a position substantially at its furthest from the end wall 3. A filling tube 50 is introduced into the channel 23 via the axial opening 21. The product, conveyed by the filling tube 50, enters the housing 30 via the lateral openings 26, 27. The air trapped in the housing 30 may escape via the vent orifice 29. Filling may continue at least until the product reaches the piston 7. The stopper 24 may then be positioned over the opening 21. If it is desirable to increase the filling rate, a provision may be made, as depicted in the alternative embodiment of FIG. 5, for the free end 122 of the rod 12 to be spaced a non-zero distance from the end wall 3.

It will be apparent to those skilled in the art that various modifications and variations can be made to the structure. Thus, it should be understood that the invention is not limited to the examples discussed in the specification. Rather, the present invention is intended to cover modifications and variations.

What is claimed is:

1. An applicator for a product, the applicator comprising:

a body comprising an interior having a non-circular cross-section and a first end closed by an applicator wall;

a piston configured to move in a sealed manner along the interior of the body;

a drive mechanism configured to drive the piston towards the applicator wall to cause product to pass through the applicator wall; and a rod associated with the drive mechanism, the rod comprising a channel passing through at least a portion of the rod, the channel having a first opening configured to open to the outside of the body and having at least one second opening located between the piston and the applicator wall when the piston is located at a maximum distance from the applicator wall, wherein the rod defines at least one vent orifice configured to allow air to escape during filling of the body with product via the channel, and wherein a portion of the channel facing the applicator wall does not open axially into the body.

2. The applicator of claim 1, wherein a portion of the applicator wall facing the rod is impermeable to product.

3. The applicator of claim 2, wherein the portion of the applicator wall comprises an area approximately equal to a cross-sectional area of the rod.

4. The applicator of claim 1, wherein the at least one vent orifice is located near the piston when the piston is located at the maximum distance from the applicator wall.

5. The applicator of claim 1, wherein the rod comprises screw threading configured to engage with corresponding screw threading provided on the piston for driving the piston towards the applicator wall.

6. The applicator of claim 5, wherein the driving mechanism comprises a rotary knob.

7. The applicator of claim 1, wherein the rod has a free end near the applicator wall and the second opening is near the free end of the rod.

8. The applicator of claim 1, wherein the rod has a free end in contact with an interior surface of the applicator wall.

9. The applicator of claim 1, wherein the at least one second opening opens axially into the body and the rod comprises a free end located at a non-zero distance from an interior surface of the applicator wall.

10. The applicator of claim 1, wherein the at least one second opening comprises two openings opening away from one another on the rod.

11. The applicator of claim 1, further comprising a bottom attached at a second end of the body, the bottom defining an opening configured to communicate with the first opening of the channel.

12. The applicator of claim 1, wherein the first opening of the channel is closed off by a stopper.

13. The applicator of claim 12, wherein the stopper is affixed to the remainder of the applicator by at least one of snap-fastening, bonding, screwing, and welding.

14. The applicator of claim 12, wherein the at least one vent orifice is closed off once the applicator has been filled with product.

15. The applicator of claim 14, wherein the at least one vent orifice is closed off by at least a portion of the stopper.

16. The applicator of claim 1, further comprising a removable seal, the removable seal being impervious to product and affixed to the applicator wall.

17. The applicator of claim 16, wherein the removable seal is affixed to the applicator wall by at least one of bonding and heat sealing.

18. The applicator of claim 16, wherein the removable seal is affixed prior to a first use.

19. The applicator of claim 1, further comprising a cap configured to be removably mounted on the body for isolating the applicator wall in a manner that is impervious to product.

20. The applicator of claim 1, further comprising product contained in the applicator, wherein the product comprises a cosmetic product.

21. The applicator of claim 1, wherein the applicator wall and the portion of the body defining the non-circular cross-section comprise a one-piece unit.

22. The applicator of claim 1, wherein the applicator wall defines a plurality of orifices.

23. The applicator of claim 22, wherein the plurality of orifices are arranged on the applicator wall to allow product to spread over substantially an entire outer surface of the applicator wall.

24. An applicator for a product, the applicator comprising:

a single-piece body comprising a portion defining an interior and an applicator wall closing a first end of the body;

a piston configured to move in a sealed manner along the interior of the body;

a drive mechanism configured to drive the piston towards the applicator wall to cause product to pass through the applicator wall; and a rod associated with the drive mechanism, the rod comprising a channel passing through at least a portion of the rod, the channel having a first opening configured to open to the outside of the body and having at least one second opening located between the piston and the applicator wall when the piston is located at a maximum distance from the applicator wall, wherein the rod defines at least one vent orifice configured to allow air to escape during filling of the body with product via the channel, and wherein a portion of the channel facing the applicator wall does not open axially into the body.

25. The applicator of claim 24, wherein the single-piece body is a single piece of molded material.

26. The applicator of claim 25, wherein the molded material comprises plastic.

27. The applicator of claim 24, wherein a portion of the applicator wall facing the rod is impermeable to product.

28. The applicator of claim 27, wherein the portion of the applicator wall comprises an area approximately equal to a cross-sectional area of the rod.

29. The applicator of claim 24, wherein the at least one vent orifice is located near the piston when the piston is located at the maximum distance from the applicator wall.

30. The applicator of claim 24, wherein the rod comprises screw threading configured to engage with corresponding screw threading provided on the piston for driving the piston towards the applicator wall.

31. The applicator of claim 30, wherein the driving mechanism comprises a rotary knob.

32. The applicator of claim 24, wherein the rod has a free end near the applicator wall and the second opening is near the free end of the rod.

33. The applicator of claim 24, wherein the rod has a free end in contact with an interior surface of the applicator wall.

34. The applicator of claim 24, wherein the at least one second opening opens axially into the body and the rod comprises a free end located at a non-zero distance from an interior surface of the applicator wall.

35. The applicator of claim 24, wherein the at least one second opening comprises two openings opening away from one another on the rod.

36. The applicator of claim 24, further comprising a bottom attached at a second end of the body, the bottom defining an opening configured to communicate with the first opening of the channel.

37. The applicator of claim 24, wherein the first opening of the channel is closed off by a stopper.

38. The applicator of claim 37, wherein the stopper is affixed to the remainder of the applicator by at least one of snap-fastening, bonding, screwing, and welding.

39. The applicator of claim 37, wherein the at least one vent orifice is closed off once the applicator has been filled with product.

40. The applicator of claim 39, wherein the at least one vent orifice is closed off by at least a portion of the stopper.

41. The applicator of claim 24, further comprising a removable seal, the removable seal being impervious to product and affixed to the applicator wall.

42. The applicator of claim 41, wherein the removable seal is affixed to the applicator wall by at least one of bonding and heat sealing.

43. The applicator of claim 41, wherein the removable seal is affixed prior to a first use.

44. The applicator of claim 24, further comprising a cap configured to be removably mounted on the body for isolating the applicator wall in a manner that is impervious to product.

45. The applicator of claim 24, further comprising product contained in the applicator, wherein the product comprises a cosmetic product.

46. The applicator of claim 24, wherein the applicator wall defines a plurality of orifices.

47. The applicator of claim 46, wherein the plurality of orifices are arranged on the applicator wall to allow product to spread over substantially an entire outer surface of the applicator wall.

48. An applicator device for a product, the applicator comprising:

a body comprising an interior and a first end closed by an applicator wall defining a plurality of orifices arranged on the applicator wall to allow product to spread over substantially an entire outer surface of the applicator wall;

a piston configured to move in a sealed manner along the interior of the body;

a drive mechanism configured to drive the piston towards the applicator wall to cause product to pass through the applicator wall; and a rod associated with the drive mechanism, the rod comprising a channel passing through at least a portion of the rod, the channel having a first opening configured to open to the outside of the body and having at least one second opening located between the piston and the applicator wall when the piston is located at a maximum distance from the applicator wall, wherein the rod defines at least one vent orifice configured to allow air to escape during filling of the body with product via the channel, and wherein a portion of the channel facing the applicator wall does not open axially into the body.

49. The applicator of claim 48, wherein a portion of the applicator wall facing the rod is impermeable to product.

50. The applicator of claim 49, wherein the portion of the applicator wall comprises an area approximately equal to a cross-sectional area of the rod.

51. The applicator of claim 48, wherein the at least one vent orifice is located near the piston when the piston is located at the maximum distance from the applicator wall.

52. The applicator of claim 48, wherein the rod comprises screw threading configured to engage with corresponding screw threading provided on the piston for driving the piston towards the applicator wall.

53. The applicator of claim 52, wherein the driving mechanism comprises rotary knob.

54. The applicator of claim 48, wherein the rod has a free end near the applicator wall and the second opening is near the free end of the rod.

55. The applicator of claim 48, wherein the rod has a free end in contact with an interior surface of the applicator wall.

56. The applicator of claim 48, wherein the at least one second opening opens axially into the body and the rod comprises a free end located at a non-zero distance from an interior surface of the applicator wall.

57. The applicator of claim 48, wherein the at least one second opening comprises two openings opening away from one another on the rod.

58. The applicator of claim 48, further comprising a bottom attached at a second end of the body, the bottom defining an opening configured to communicate with the first opening of the channel.

59. The applicator of claim 48, wherein the first opening of the channel is closed off by a stopper.

60. The applicator of claim 59, wherein the stopper is affixed to the remainder of the applicator by at least one of snap-fastening, bonding, screwing, and welding.

61. The applicator of claim 59, wherein the at least one vent orifice is closed off once the applicator has been filled with product.

62. The applicator of claim 61, wherein the at least one vent orifice is closed off by at least a portion of the stopper.

63. The applicator of claim 48, further comprising a removable seal, the removable seal being impervious to product and affixed to the applicator wall.

64. The applicator of claim 63, wherein the removable seal is affixed to the applicator wall by at least one of bonding and heat sealing.

65. The applicator of claim 63, wherein the removable seal is affixed prior to a first use.

66. The applicator of claim 48, further comprising a cap configured to be removably mounted on the body for isolating the applicator wall in a manner that is impervious to product.

67. The applicator of claim 48, further comprising product contained in the applicator, wherein the product comprises a cosmetic product.

68. An applicator for a product, the applicator comprising:

a body comprising an interior and a first end closed by an applicator wall;

a piston configured to move in a sealed manner along the interior of the body;

a drive mechanism configured to drive the piston towards the applicator wall to cause product to pass through the applicator wall; and a rod associated with the drive mechanism, the rod comprising a channel passing through at least a portion of the rod and a free end in contact with an interior surface of the applicator wall, the channel having a first opening configured to open to the outside of the body and having at least one second opening located between the piston and the applicator wall when the piston is located at a maximum distance from the applicator wall, wherein the rod defines at least one vent orifice configured to allow air to escape during filling of the body with product via the channel.

69. An applicator for a product, the applicator comprising:

a body comprising an interior and a first end closed by an applicator wall;

a piston configured to move in a sealed manner along the interior of the body;

a drive mechanism configured to drive the piston towards the applicator wall to cause product to pass through the applicator wall; and a rod associated with the drive mechanism, the rod comprising a channel passing through at least a portion of the rod, the channel having a first opening configured to open to the outside of the body and having at least two openings located between the piston and the applicator wall when the piston is located at a maximum distance from the applicator wall, the two openings opening away from one another on the rod, wherein the rod defines at least one vent orifice configured to allow air to escape during filling of the body with product via the channel.

* * * * *